US009289976B2

(12) United States Patent
Paulson et al.

(10) Patent No.: US 9,289,976 B2
(45) Date of Patent: Mar. 22, 2016

(54) AUTOMATED HIGH PERFORMANCE WAVEFORM DESIGN BY EVOLUTIONARY ALGORITHM

(75) Inventors: Christopher Paulson, Palo Alto, CA (US); Steven E. Ready, Los Altos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 595 days.

(21) Appl. No.: 13/563,445

(22) Filed: Jul. 31, 2012

(65) Prior Publication Data

US 2014/0035992 A1 Feb. 6, 2014

(51) Int. Cl.
*B41J 29/393* (2006.01)
*B41J 2/045* (2006.01)

(52) U.S. Cl.
CPC ..... *B41J 2/04536* (2013.01); *B41J 2/0456* (2013.01); *B41J 2/0459* (2013.01); *B41J 2/04535* (2013.01); *B41J 2/04581* (2013.01); *B41J 2/04588* (2013.01); *B41J 2/04591* (2013.01)

(58) Field of Classification Search
CPC ..... B41J 2/04536; B41J 2/04588; B41J 2/04581; B41J 2/0459; B41J 2/04591; B41J 2/04558; B41J 2/0456; B41J 2/04535
USPC ..... 347/19; 341/110; 358/1.9; 382/274; 271/9.1
See application file for complete search history.

(56) References Cited

U.S. PATENT DOCUMENTS 5,479,168 A * 12/1995 Johnson et al. ..... 341/110
6,286,922 B1 * 9/2001 Kondou ..... B41J 2/04541 310/316.01
2003/0053098 A1 * 3/2003 Hagai et al. ..... 358/1.9
2005/0185855 A1 * 8/2005 Suzuki ..... 382/274
2006/0033768 A1 * 2/2006 Uraki ..... B41J 2/0451 347/14
2007/0057979 A1 * 3/2007 Gardner ..... B41J 2/0456 347/5
2009/0096823 A1 * 4/2009 Watt ..... B41J 2/17593 347/10
2012/0056365 A1 * 3/2012 Kato ..... 271/9.1

FOREIGN PATENT DOCUMENTS

EP 0334546 * 9/1989 ..... B41J 2/045

* cited by examiner

*Primary Examiner* — Julian Huffman
(74) *Attorney, Agent, or Firm* — Marger Johnson

(57) ABSTRACT

A method can include receiving an initial waveform and generating, testing, and evaluating the performance of an initial child set of waveforms based on an initial parent set of waveforms from the initial waveform. The method can also include determining whether a termination condition has been met based on the evaluating and, if so, providing an optimized waveform. If the termination condition has not been met, the method can also include generating subsequent child sets of waveforms based on the previous child set(s).

20 Claims, 8 Drawing Sheets

AUTOMATED HIGH PERFORMANCE WAVEFORM DESIGN BY EVOLUTIONARY ALGORITHM

TECHNICAL FIELD

The disclosed technology relates to the field of waveform optimization, and more particularly to using real-time system feedback and an evolutionary algorithm for optimizing inkjet printer waveforms.

BACKGROUND

Current technologies attempting to optimize waveforms, such as inkjet printer waveforms, typically include the manual modification of a single parameter and monitoring of a single outcome. These techniques tend to be extraordinarily labor-intensive, significantly time-consuming, notably inaccurate, or a combination thereof. Further, such current techniques largely ignore any variable coupling, which generally makes such techniques inefficient as search algorithms.

Accordingly, there remains a need for improved high-performance waveform design optimization.

DETAILED DESCRIPTION

Implementations of the disclosed technology may provide advanced, multi-objective waveform optimization with little or no human input. Such implementations may greatly reduce development effort and time, as well as increasing the likelihood of resulting in the optimal solution. Embodiments of the disclosed technology generally harness the power of evolutionary algorithms to modify a real-world system and evaluate performance based on real-world results. Since the disclosed technology generally uses image processing as the performance feedback mechanism, data acquisition rates are typically limited only by camera frame rates and data transfer rates.

Waveform optimization techniques in accordance with the disclosed technology can involve implementations of many search methodologies. There are three assumptions that support the use of an evolutionary algorithm for waveform optimization, two of which generally apply at a system level. A first assumption is that the system is free of waveform hysteresis effects and that performance results are time-invariant. This implies that many waveforms can be tested over a long period of time while the fundamental response of the system remains static.

A second assumption is that there are fundamental characteristics of a waveform, e.g., a certain slope or dwell time, that are necessary for high-performance waveforms. A third assumption is that the evolutionary algorithm used for waveform optimization includes a built-in reinforced learning capability as well as the potential for the addition of more advanced methods of reinforced learning. Assuming the system's performance is shown to be static, the evolutionary algorithm has the capability of testing thousands of waveforms and retaining that information for future waveform creation.

Implementations generally provide that, if a particular waveform performs well, the key features of the waveform may be promoted in future generations until a superior waveform is found. This means, for example, that a single waveform could potentially influence the creation of every subsequent waveform.

Alternatively or in addition thereto, trend data may be extracted to allow the evolutionary algorithm to generate 'heuristic' rules for finding better waveforms. For example, if a drop velocity is too high, the algorithm may determine that the peak-to-peak waveform voltage is the most representative relationship between the waveform and drop velocity. In the next generation, the algorithm may apply this knowledge and reduce the amplitude of the waveform in order to reduce the velocity.

Figure 1:
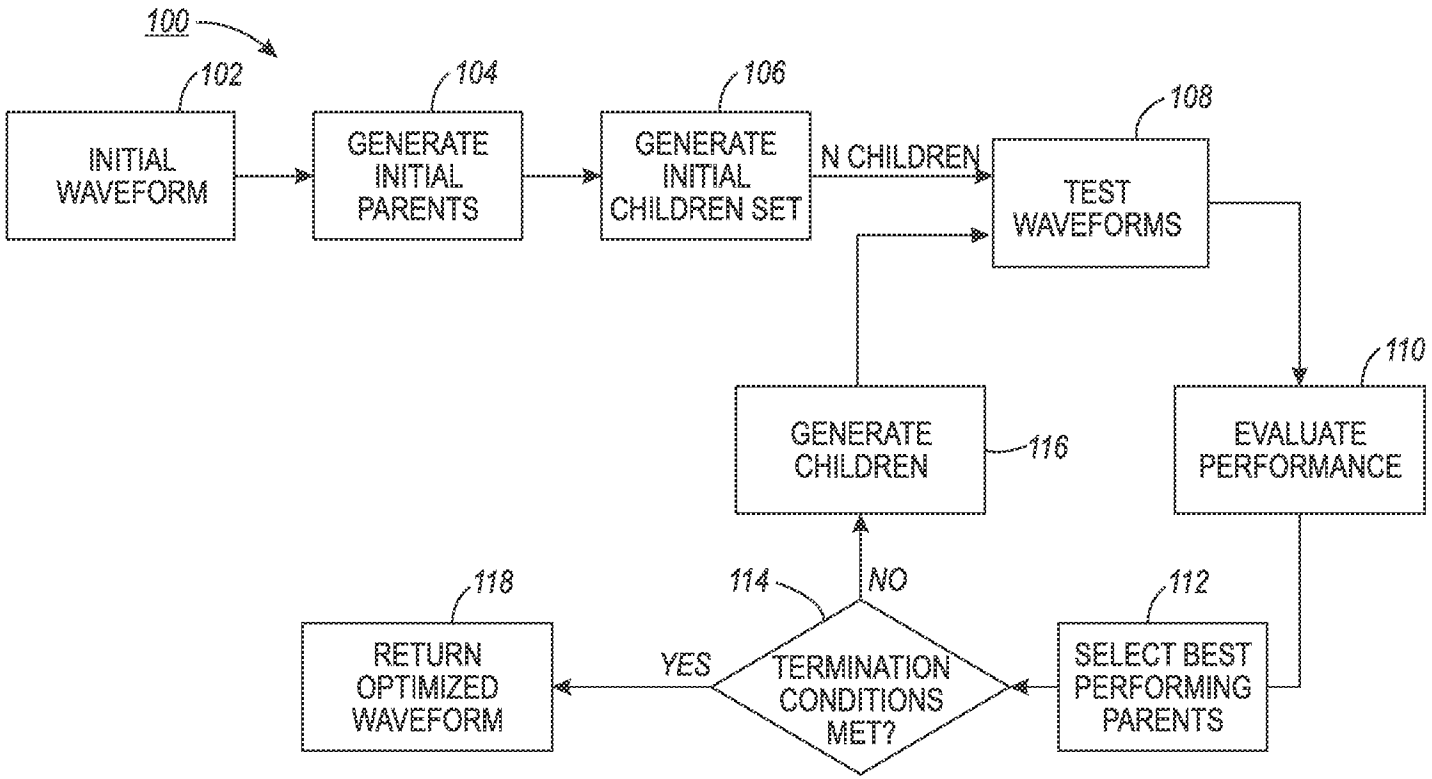
FIG. 1 is a flowchart that illustrates an example of an evolutionary algorithm method in accordance with certain embodiments of the disclosed technology.

FIG. 1 is a flowchart illustrating an example of an evolutionary algorithm method 100 in accordance with certain embodiments of the disclosed technology. At 102, an initial waveform is received or otherwise selected. The initial waveform may be selected either by a user or automatically by the system. At 104, an additional parent or multiple parents are generated by mutation from the initial waveform from 102. At 106, an initial children set is generated. The initial children set generated at 106 may include N children. In order to produce diversity in the initial set, all waveforms may be generated through mutations of the initial waveform. As used herein, the term mutation generally refers to a random change in some aspect or multiple aspects of the waveform.

At 108, the waveforms are tested. The waveforms may be automatically tested based on user direction or user-specified metrics, for example. Such testing may include any pertinent waveform testing methods or techniques or combination thereof. After the testing at 108 is complete, the performance of the waveforms is evaluated, as indicated by 110.

The evaluation of the performance of the waveforms at 108 may be calculated using a fitness function. In certain embodiments, the fitness function requires two inputs: a specified target value from a user and a measured value resulting from the testing at 108. The returned value from the fitness function generally indicates how close the measured value is to the target value. Once the waveform performance has been measured, the best performing waveforms are determined as indicated by 112. The algorithm then determines whether any termination conditions have been met, as indicated by 114.

Responsive to a determination at 114 that the termination condition has been met or, if multiple termination conditions were specified, that all of the termination conditions have been met, the evolutionary algorithm method 100 returns the most optimized waveform, as indicated by 118. In certain implementations, the best waveforms may be accessible through data post-processing routines.

Responsive to a determination at 114 that no termination condition has been met or, if multiple termination conditions were specified, that less than all of the termination conditions have been met, if any, the evolutionary algorithm method 100 may generate the next set of waveforms for testing, as indicated by 116. These waveforms are referred to herein as children waveforms. Once the children waveforms have been generated at 116, the method 100 proceeds to 108 such that the children waveforms may be tested in accordance with the techniques applied to the previous set of child waveforms.

Waveform parameterization generally occurs at two levels. The more basic parameterization of a waveform typically includes breaking a single waveform into multiple sections or segments that are smaller and more logical. Additionally, for the purpose of mutation, each section can be further parameterized.

Waveforms generally include series of arbitrary, time-sequential nodes. Each node may be specified by a time and a voltage, or two independent degrees of freedom. An average waveform is typically on the order of twenty nodes. Accordingly, waveform optimizer techniques must generally be able to solve for forty degrees of freedom simultaneously. Because this can be a difficult task that requires considerable time, certain techniques may be employed to reduce the degree-of-freedom magnitude of the problem.

One technique for reducing the degree-of-freedom magnitude is to modify only a subset of the nodes. However, this may limit the freedom of the waveform optimizer to find the best solution. Alternatively, the waveform optimizer may break the waveform into smaller sections or segments. An individual waveform segment thus becomes a single degree of freedom. For example, FIGS. 3 and 4 (described below) respectively illustrate a waveform and a decomposing of the waveform into smaller segments.

Figure 2:
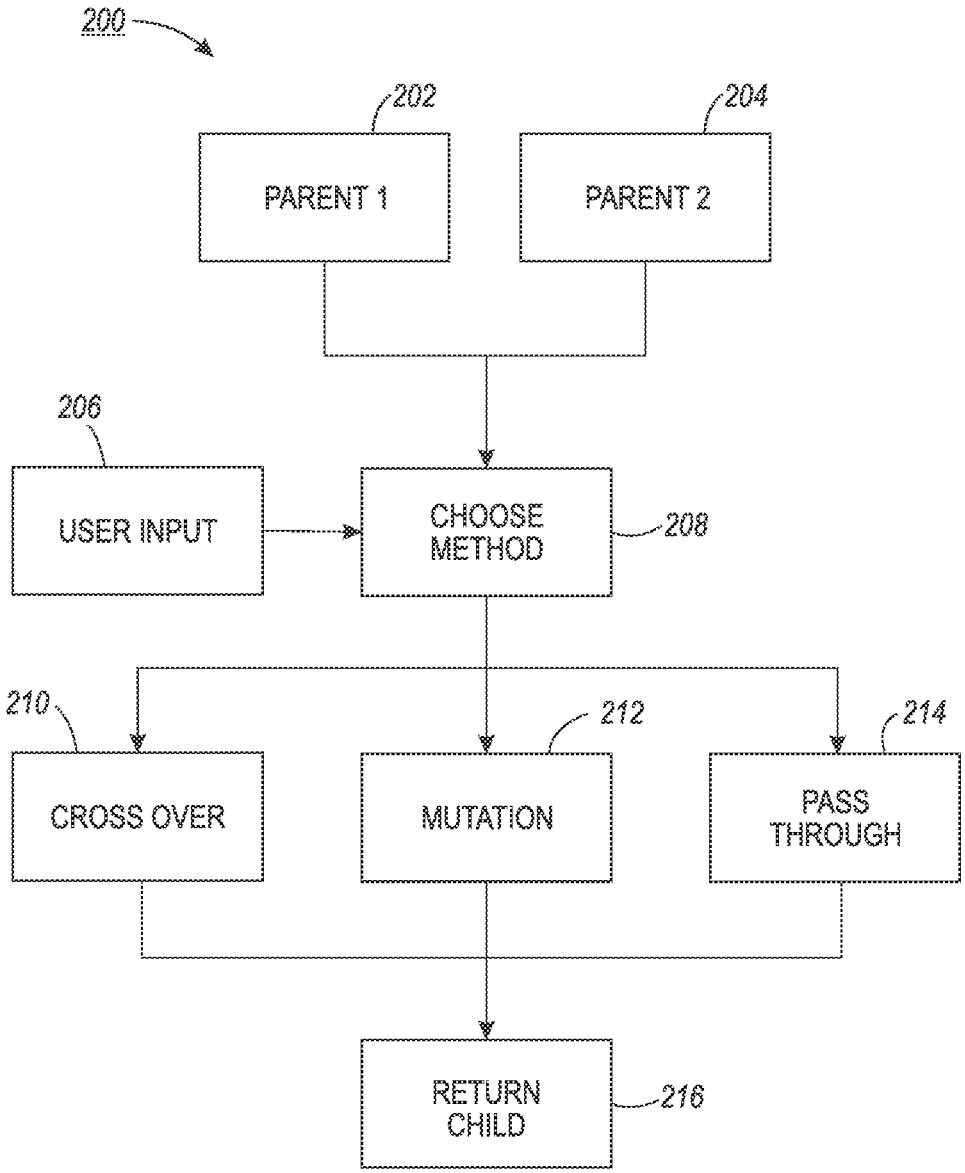
FIG. 2 is a flowchart that illustrates an example of a child waveform generation method in accordance with certain embodiments of the disclosed technology.

FIG. 2 is a flowchart illustrating an example of a child waveform generation method 200 in accordance with certain embodiments of the disclosed technology. This method 200 may be used to generate the children at 104 of FIG. 1, for example. The method 200 begins with the receiving or selection of two parent waveforms, Parent 1 and Parent 2, as indicated by 202 and 204, respectively. In certain embodiments, the parent waveforms at 202 and 204 may be the initial parent set generated at 104 of FIG. 1. In alternative embodiments, the child waveform generation method 200 fully represents the child generation performed at 112 of FIG. 1.

At 208, a particular method is selected to be used in generating the child waveforms. The method may be selected based on user input, as indicated by 206. The user input at 206 may include, for example, inputs specified by the user at the start of the waveform optimization. The method(s) selected at 208 may include cross over, mutation, or pass through techniques, as indicated by 210, 212, and 214, respectively. In certain implementations, two or more of the individual techniques 210-214 may be selected and applied. The selected method(s) may represent the outcome of a previous performance evaluation at 110 of FIG. 1 or be used in connection therewith.

After completion of the selected method(s), one or more child waveforms may be provided, as indicated by 216. These child waveforms may then be tested, e.g., by the testing performed at 108 of FIG. 1.

It should be noted that, while the waveforms to be optimized as described herein are generally inkjet printer waveforms, implementations of the disclosed technology may be applied to any of a number of other types of waveforms.

Figure 3:
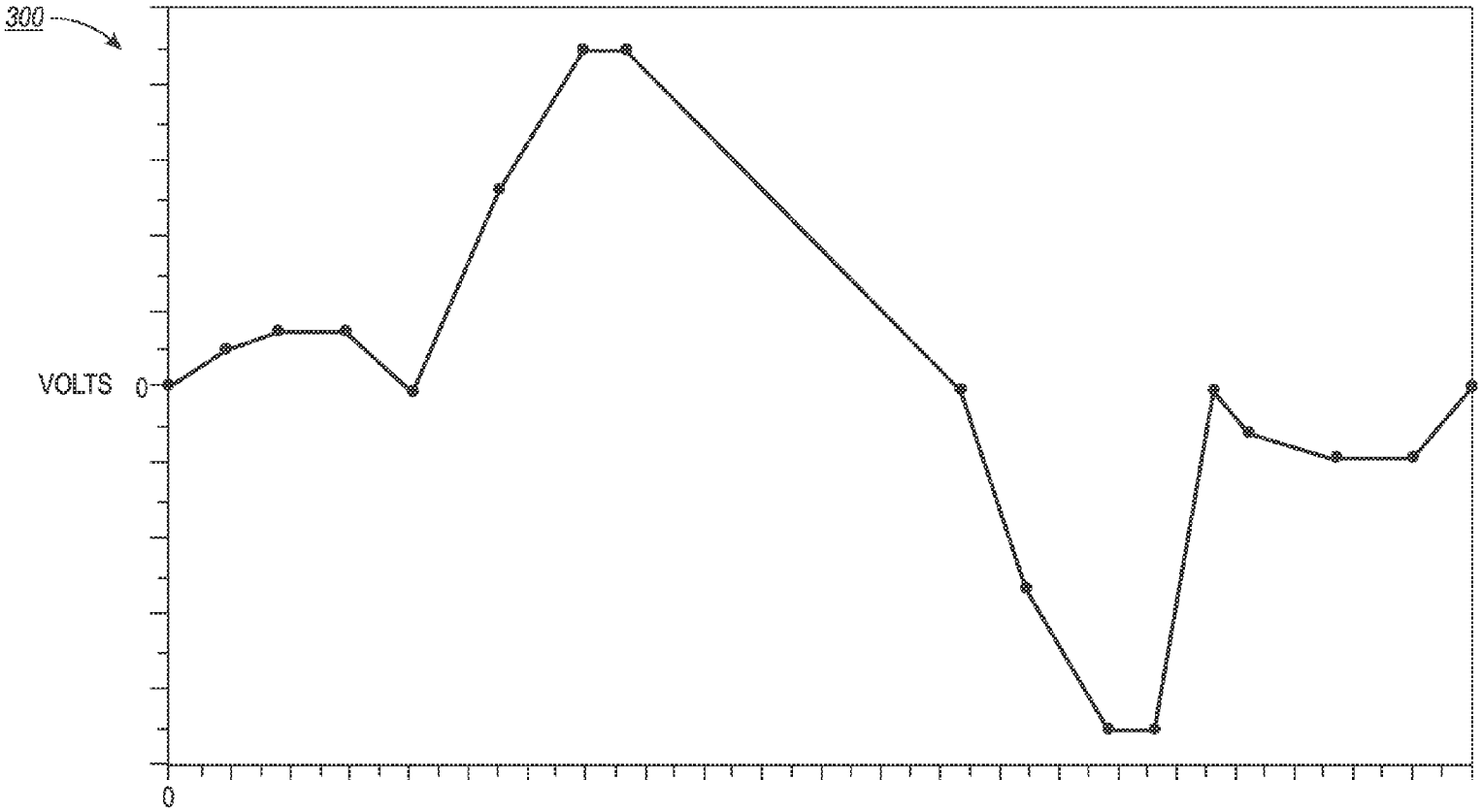
FIG. 3 is a graphing that illustrates an initial waveform in accordance with certain embodiments of the disclosed technology.
Figure 4:
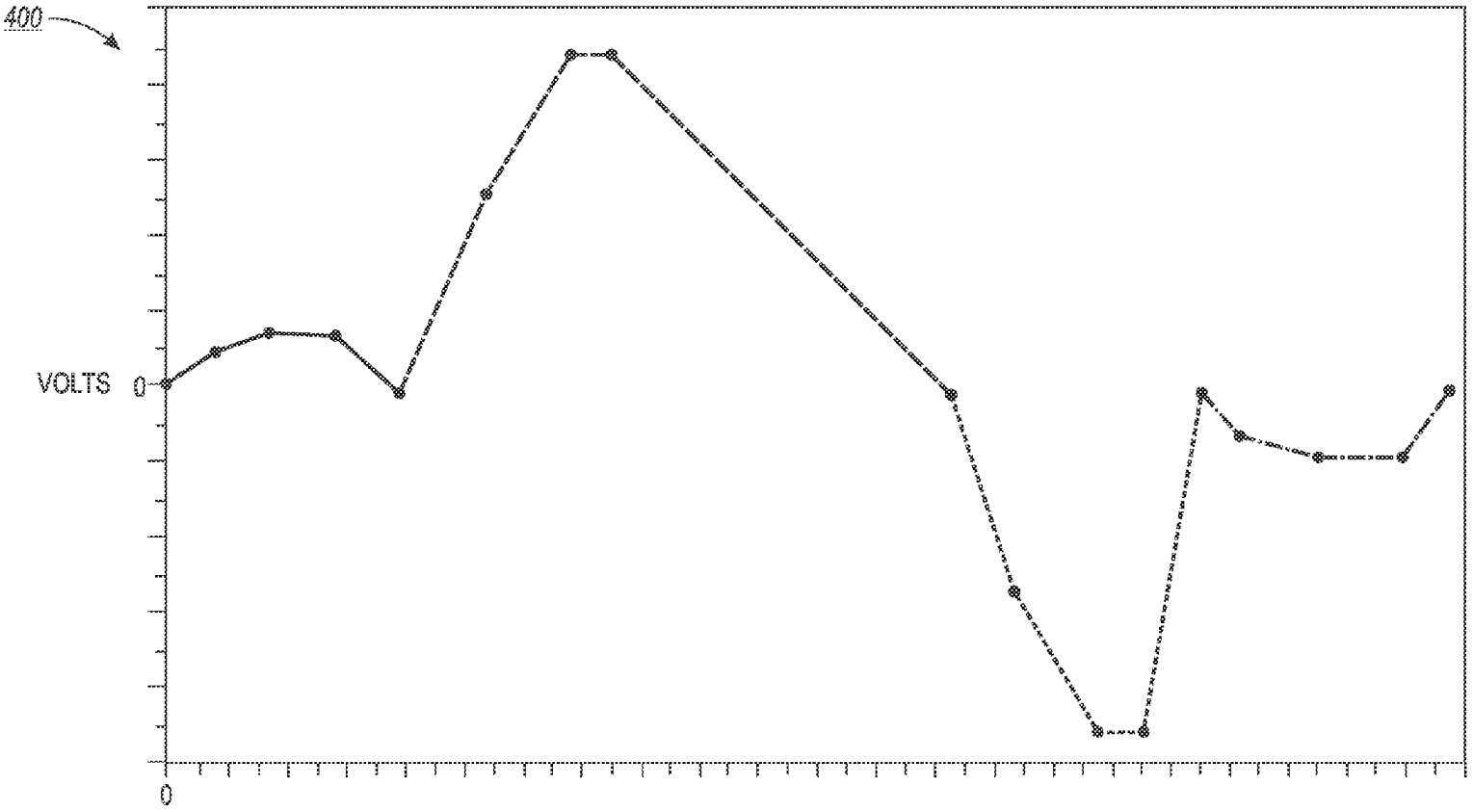
FIG. 4 is a graphing that illustrates a segmented waveform, such as would result from application of the disclosed waveform optimization techniques to the initial waveform of FIG. 3, in accordance with certain embodiments of the disclosed technology.

FIG. 3 is a graphing 300 that illustrates an initial waveform, such as the initial waveform at 102 of FIG. 1, in accordance with certain embodiments of the disclosed technology. FIG. 4 is a graphing 400 that illustrates a segmented waveform, such as would result from application of the disclosed waveform optimization techniques to the initial waveform of FIG. 3, in accordance with certain embodiments of the disclosed technology.

As can be seen in FIG. 4, each individual segment begins and ends at zero volts. A rule of the system that the segment retain this feature may be specified, thus specifying that mutations do not modify the voltage of these zero volt nodes. Other rules governing certain aspects of waveform modification may be applied to designate system requirements.

Mutation is generally the only method in the waveform optimization routine to introduce new variations of the waveform to a test. Mutation may be used to generate the initial waveform set for testing and may also be used for every subsequent generation to introduce diversity into the test set, for example. In situations without mutation, a waveform optimizer may choose the best waveform in the set and, slowly over time, all other waveforms would converge to that waveform, or to a local optimum.

Figure 5:
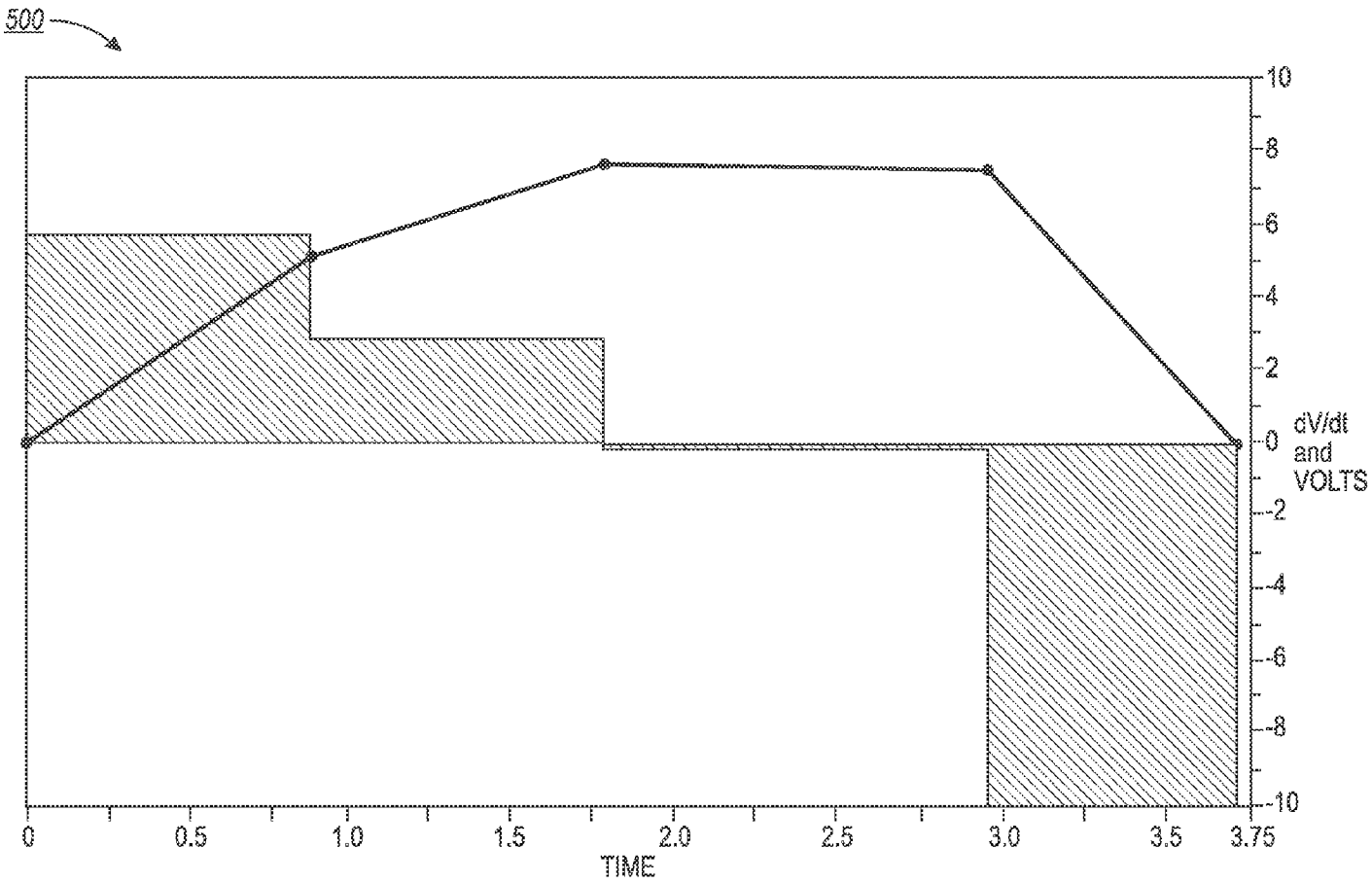
FIG. 5 is a graphing that illustrates an example of a waveform segment and its complementary dV/dt parameterization in accordance with certain embodiments of the disclosed technology.

Mutation as described herein generally refers to the modification of a parameter by a random percentage within a user-defined waveform modification range. Each waveform segment that enters the mutation operator is comprised of voltage and time nodes. In situations where the mutation operator acts on either voltage or time, values having large amplitudes will typically have a much larger variation range. However, the waveform segment may be broken into differential times and differential voltages, or slope, to ensure that all parameters are modified equally. After modification is complete, the waveform segment may be reconstructed. FIG. 5 is a graphing 500 that illustrates a waveform segment and its complementary dV/dt parameterization in accordance with certain embodiments of the disclosed technology.

In certain implementations, a fitness function may be employed by the evolutionary algorithm to determine how close a measured result is to the desired target value. The ideal value for the evolutionary algorithm is typically at either a maximum of the function or at a minimum of the function. The function must generally be a well-behaved function having clearly defined boundaries. A custom fitness function as used within the evolutionary algorithm may be based on a quadratic loss function:

$$\text{Loss}(x) = \frac{1}{T}(T - x)^2$$

After inversion and normalization of the quadratic loss function, the function used for the evolutionary algorithm may take the following form:

$$\text{Loss}(x) = \frac{T^2}{(T-x)^2 + \frac{T^2}{C}}$$

Figure 6:
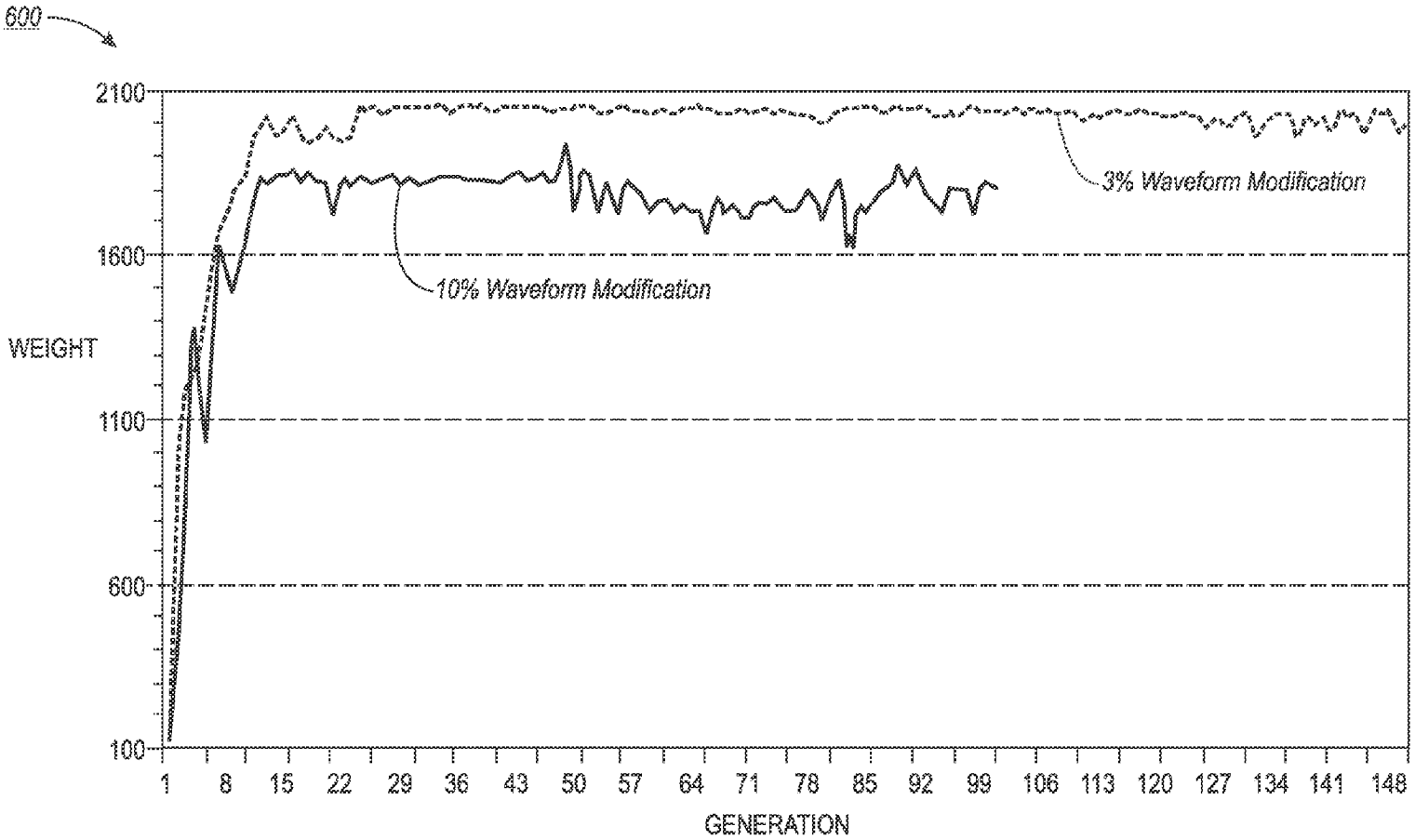
FIG. 6 is a graphing that illustrates two different optimizations resulting from application of waveform optimization techniques in accordance with the disclosed technology.

FIG. 6 is a graphing 600 that illustrates two different optimizations resulting from application of waveform optimization techniques in accordance with the disclosed technology. A first line represents a 10% modification rate and a second line represents a 3% modification rate, as indicated in the graphing 600. In the example, the number of generations is different for each optimization. Whereas 100 generations of data were collected for the 10% modification rate test, that amount was increased to 150 generations for the 3% modification rate test.

The graphing 600 illustrates that the initial waveform weight improvement of the two scans is similar. However, the 10% rate scan shows increased noise. This noise may be attributed to large modifications to the waveforms. While less statistically probable, there is some chance that a waveform displaying poor jetting behavior is passed through several waveform generations. The evolutionary algorithm will likely ultimately correct the mistake but, in the process, it may produce large variations in the mean weight value. If the waveform modification rate is too large, the evolutionary algorithm may not or not be able to correct the problem and instead settle at a solution that may be sub-optimal. A modification rate of 10% is typically considered the maximum rate.

Figure 7:
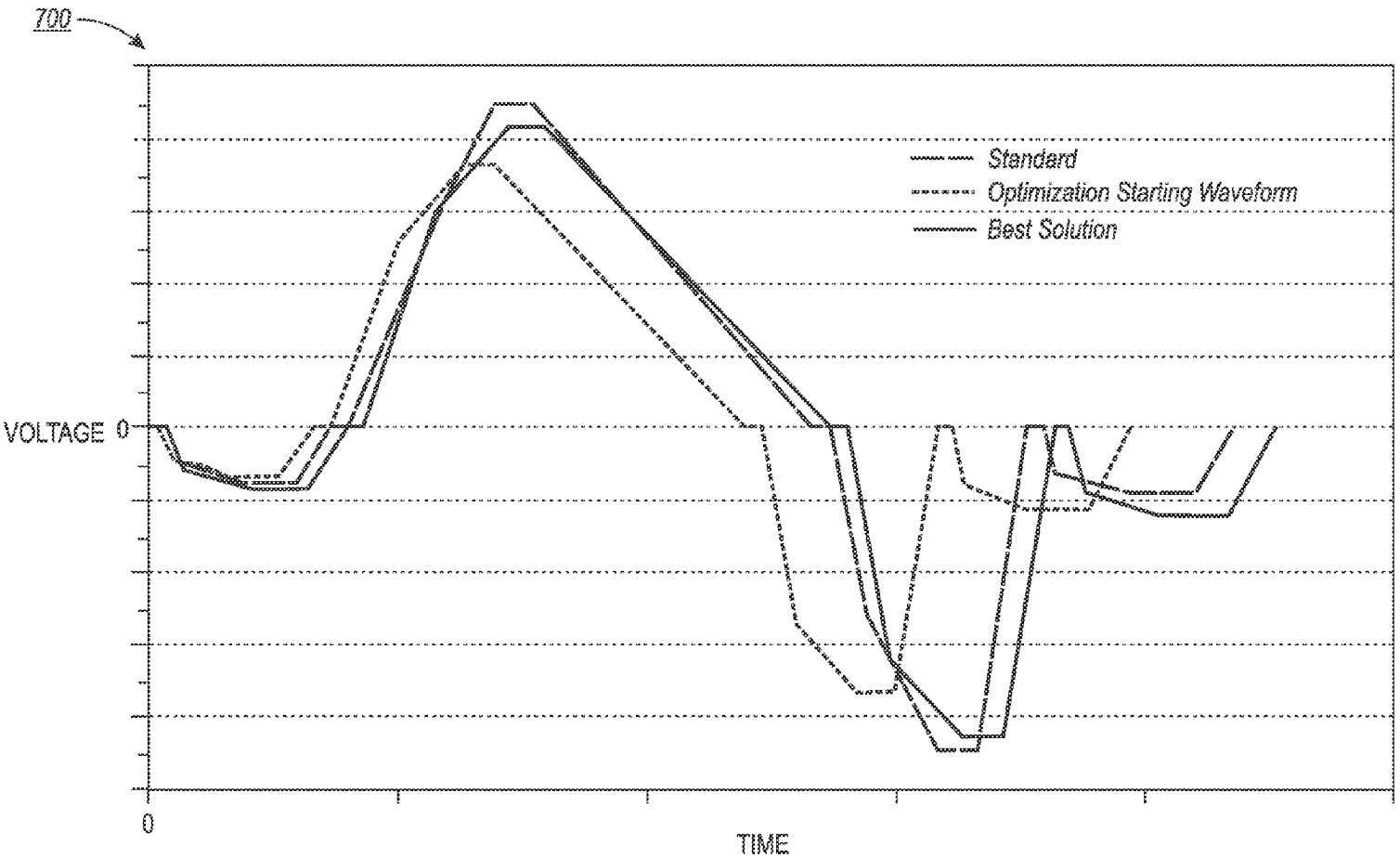
FIG. 7 is a graphing that illustrates an example including three waveforms in accordance with the disclosed technology.

FIG. 7 is a graphing 700 that illustrates an example including three waveforms in accordance with the disclosed technology. A first line in the graphing 700 represents the standard reference manually optimized waveform, a second line represents the initial or non-optimal starting waveform, and a third line represents the optimized waveform resulting from application of a waveform optimizer in accordance with the disclosed technology. In the example, the data were generated from 3% modification rate data as discussed above. The shape of the final optimized waveform is similar in character to that of the standard waveform and significantly different from that of the initial waveform. In the example, the jetting behavior of the optimal waveform is nominally the same as the performance of the standard waveform.

Figure 8:
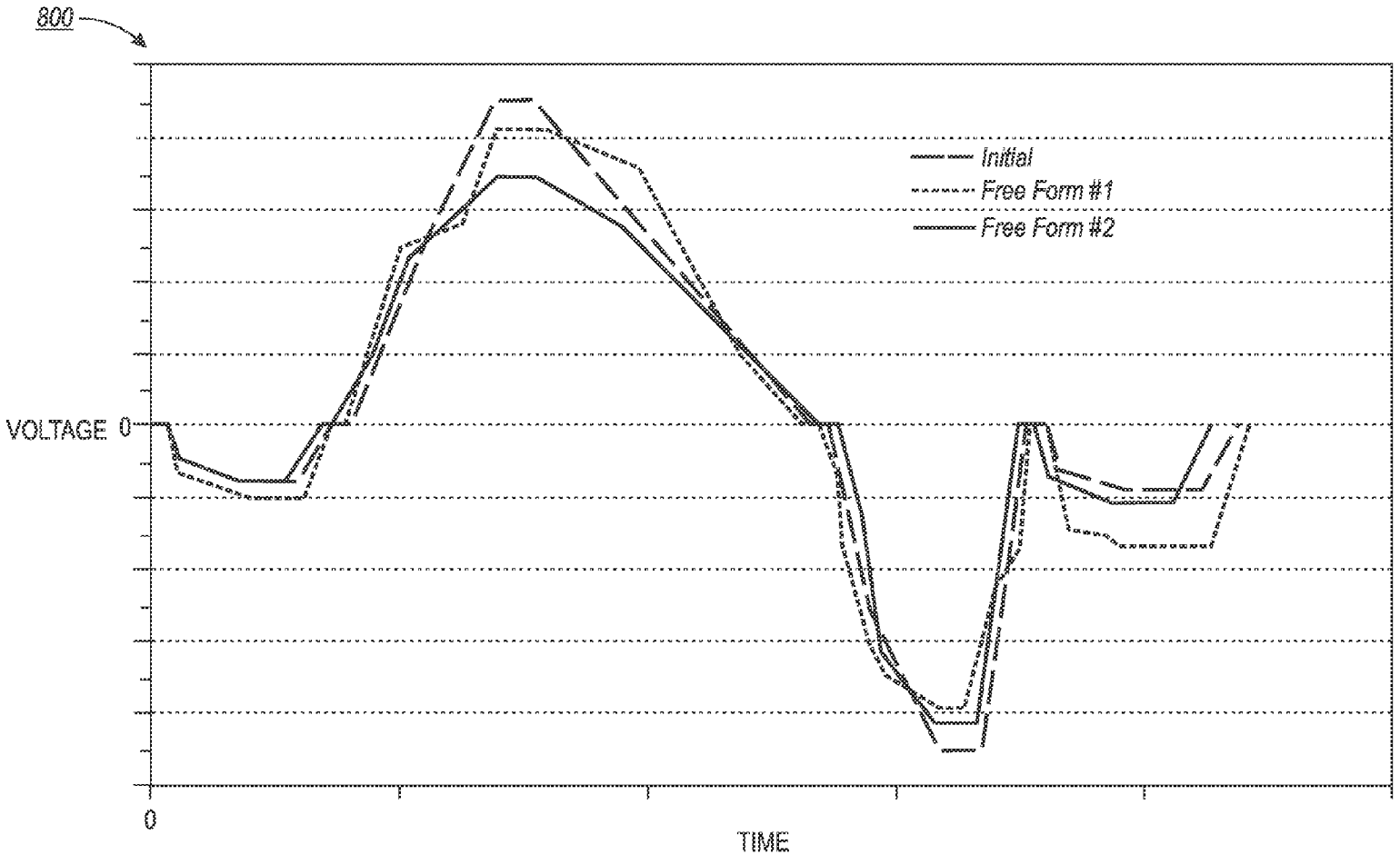
FIG. 8 is a graphing that illustrates another example including three waveforms in accordance with the disclosed technology.

FIG. 8 is a graphing 800 that illustrates another example including three waveforms in accordance with the disclosed technology. The example illustrated by FIG. 8 is similar to the example illustrated by FIG. 7 except that additional nodes were added to the initial waveform in the example illustrated by FIG. 8. This may be done using linear interpolation between existing nodes, for example, which roughly doubles the number of nodes.

Because waveform mutation generally acts on the slope and time difference between nodes, the addition of more nodes typically leads to a fundamental change in the shape of the waveform, as can be seen in the graphing 800 of FIG. 8, which shows the top two waveforms from a waveform optimization and the initial waveform. Among the key features of these waveforms are the resulting elimination of sharp slope changes. That is, both of the waveforms in the graphing 800 appear to be rounded: one on the positive portion of the drop formation pulse and the other on the negative side of the drop formation pulse. It is known from simulation results that the rounding of waveform features generally reduce the negative effects of fluidic resonances in a print head.

In alternative embodiments of the evolutionary algorithm approach to waveform modification as described herein, image analysis feedback may be replaced by a piezo feedback mechanism or other suitable feedback mechanism. Such embodiments may serve to reduce the amount of time required to make a measurement and also allow for direct observation of cavity resonance.

The following discussion is intended to provide a brief, general description of a suitable machine in which certain embodiments of the disclosed technology can be implemented. As used herein, the term "machine" is intended to broadly encompass a single machine or a system of communicatively coupled machines or devices operating together. Exemplary machines can include computing devices such as personal computers, workstations, servers, portable computers, handheld devices, tablet devices, and the like.

Typically, a machine includes a system bus to which processors, memory (e.g., random access memory (RAM), read-only memory (ROM), and other state-preserving medium), storage devices, a video interface, and input/output interface ports can be attached. The machine can also include embedded controllers such as programmable or non-programmable logic devices or arrays, Application Specific Integrated Circuits, embedded computers, smart cards, and the like. The machine can be controlled, at least in part, by input from conventional input devices (e.g., keyboards and mice), as well as by directives received from another machine, interaction with a virtual reality (VR) environment, biometric feedback, or other input signal.

The machine can utilize one or more connections to one or more remote machines, such as through a network interface, modem, or other communicative coupling. Machines can be interconnected by way of a physical and/or logical network, such as an intranet, the Internet, local area networks, wide area networks, etc. One having ordinary skill in the art will appreciate that network communication can utilize various wired and/or wireless short range or long range carriers and protocols, including radio frequency (RF), satellite, microwave, Institute of Electrical and Electronics Engineers (IEEE) 545.11, Bluetooth, optical, infrared, cable, laser, etc.

Embodiments of the disclosed technology can be described by reference to or in conjunction with associated data including functions, procedures, data structures, application programs, instructions, etc. that, when accessed by a machine, can result in the machine performing tasks or defining abstract data types or low-level hardware contexts. Associated data can be stored in, for example, volatile and/or non-volatile memory (e.g., RAM and ROM) or in other storage devices and their associated storage media, which can include hard-drives, floppy-disks, optical storage, tapes, flash memory, memory sticks, digital video disks, biological storage, and other tangible, physical, non-transitory storage media.

Associated data can be delivered over transmission environments, including the physical and/or logical network, in the form of packets, serial data, parallel data, propagated signals, etc., and can be used in a compressed or encrypted format. Associated data can be used in a distributed environment, and stored locally and/or remotely for machine access.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method, comprising:

receiving as input an initial waveform;

generating an initial parent set of waveforms based on the initial waveform;

generating an initial child set of waveforms based on the initial parent set of waveforms;

testing the initial child set of waveforms;

evaluating performance of the initial child set of waveforms based on the testing thereof;

determining whether at least one termination condition has been met based on the performance evaluation of the initial child set of waveforms; and responsive to a determination that the at least one termination condition has been met by the initial child set of waveforms, providing as output an optimized waveform based on the initial child set of waveforms.

2. The method of claim 1, wherein the initial waveform is an inkjet printer waveform.

3. The method of claim 1, wherein the optimized waveform is an inkjet printer waveform.

4. The method of claim 1, further comprising:

responsive to a determination that the at least one termination condition has not been met by the initial child set of waveforms, generating a first subsequent child set of waveforms based on the initial child set of waveforms.

5. The method of claim 4, wherein generating the first subsequent child set of waveforms comprises selecting at least one child generation technique to be applied to the initial child set of waveforms.

6. The method of claim 5, wherein the selecting is based at least in part on user input.

7. The method of claim 5, wherein the at least one child generation technique comprises at least one of a group consisting of: a cross-over technique, a mutation technique, and a pass-through technique.

8. The method of claim 7, further comprising applying the at least one selected child generation technique to the initial parent set of waveforms.

9. The method of claim 4, further comprising:

testing the first subsequent child set of waveforms;

evaluating performance of the first subsequent child set of waveforms based on the testing thereof;

determining whether the at least one termination condition has been met based on the performance evaluation of the first subsequent child set of waveforms; and responsive to a determination that the at least one termination condition has been met by the first subsequent child set of waveforms, providing as output an optimized waveform based on the first subsequent child set of waveforms.

10. The method of claim 9, further comprising:

responsive to a determination that the at least one termination condition has not been met by the first subsequent child set of waveforms, generating a second subsequent child set of waveforms based on the first subsequent child set of waveforms.

11. The method of claim 10, wherein generating the second subsequent child set of waveforms comprises selecting at least one child generation technique to be applied to the first subsequent child set of waveforms.

12. The method of claim 11, wherein the selecting is based at least in part on user input.

13. The method of claim 11, wherein the at least one child generation technique comprises at least one of a group consisting of: a cross-over technique, a mutation technique, and a pass-through technique.

14. The method of claim 11, further comprising applying the at least one selected child generation technique to the subsequent child set of waveforms.

15. The method of claim 10, further comprising:

testing the second subsequent child set of waveforms;

evaluating performance of the second subsequent child set of waveforms based on the testing thereof;

determining whether the at least one termination condition has been met based on the performance evaluation of the second subsequent child set of waveforms; and responsive to a determination that the at least one termination condition has been met by the second subsequent child set of waveforms, providing as output an optimized waveform based on the second subsequent child set of waveforms.

16. One or more non-transitory computer-readable media that, when executed by a processor, cause the processor to perform the method of claim 1.

17. A method, comprising:

generating parent waveforms based on an initial waveform;

testing the parent waveforms;

evaluating performance of the parent waveforms based on the testing;

repeatedly generating child waveforms based on the parent waveforms, testing the child waveforms, and evaluating performance of the testing thereof until a termination condition has been met; and providing an optimized waveform.

18. The method of claim 17, wherein the optimized waveform is suitable for use by an inkjet printer.

19. One or more non-transitory computer-readable media that, when executed by a processor, cause the processor to perform the method of claim 17.

20. A system, comprising:

a memory configured to store waveform data, the waveform data comprising an initial waveform; and a processor configured to:

generate an initial parent set of waveforms based on the initial waveform;

generate an initial child set of waveforms based on the initial parent set of waveforms;

test the initial child set of waveforms;

evaluate performance of the initial child set of waveforms based on the testing thereof;

determine whether at least one termination condition has been met based on the performance evaluation of the initial child set of waveforms; and responsive to a determination that the at least one termination condition has been met by the initial child set of waveforms, provide as output an optimized waveform.

* * * * *